United States Patent [19]

Kwasnik et al.

[11] 4,385,963

[45] May 31, 1983

[54] APPARATUS TO RECEIVE COKE FROM AN OVEN CHAMBER FOR QUENCHING

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 298,259

[22] Filed: Aug. 31, 1981

[30] Foreign Application Priority Data

Sep. 6, 1980 [DE] Fed. Rep. of Germany ..... 3033610

[51] Int. Cl.[3] ..... C10B 33/00; C10B 39/14; C10B 41/02

[52] U.S. Cl. ..... 202/263; 202/269

[58] Field of Search ..... 202/262, 263, 269

[56] References Cited

U.S. PATENT DOCUMENTS

| | | | |
|---|---|---|---|
| 3,788,236 | 1/1974 | Edgar et al. | 202/263 |
| 3,846,252 | 11/1974 | Edgar et al. | 202/263 |
| 3,984,289 | 10/1976 | Sustarsic et al. | 202/263 |
| 4,029,551 | 6/1977 | Riecker | 202/263 |
| 4,196,054 | 4/1980 | Becker et al. | 202/263 |
| 4,198,275 | 4/1980 | Riecker et al. | 202/263 |
| 4,211,608 | 7/1980 | Kwasnoski et al. | 202/263 |

*Primary Examiner*—Bradley Garris

*Attorney, Agent, or Firm*—Thomas H. Murray; Clifford A. Poff

[57] ABSTRACT

A coke car is traversed along a battery of coke ovens and receives hot coke discharged through a fall space in an overlying smoke collector hood. The car is moved slowly only a short distance along the battery during the coke pushing operation while it is loaded wih coke at one end of the car and progresses slowly to the other end thereof. Horizontal end sealing plates are fitted to the car and the hood at the level of the top edges of the end walls on each side of the car and hood. The total of the length of the two sealing plates is not less than the distance traveled by the car during coke pushing. Gaps are left between the bottom edges of the side walls of the smoke hood or extension plates disposed thereon and the sealing plates on the coke car. The gaps allow entry of air into the hood for uniform extraction of the emissions formed during the coke pushing operation. In addition, gaps of equal width can also be left between the top edges of the longitudinal walls of the car and hood.

5 Claims, 6 Drawing Figures

APPARATUS TO RECEIVE COKE FROM AN OVEN CHAMBER FOR QUENCHING

BACKGROUND OF THE INVENTION

This invention relates to a coke receiving and quenching car adapted to traverse a battery of coke ovens in combination with a smoke collector hood for the quenching car. More particularly, the present invention relates to an arrangement of parts including sealing plates on such a quenching car and hood which form a gap to permit entry of a small quantity of air into the smoke hood during the coke pushing operation.

In a battery of coke oven chambers, a coke cake is pushed from an oven chamber into a container which, according to usual practice, takes the form of an inclined quenching car which can move along the coke oven battery and to a position beneath a quenching tower. As the quenching car is taken past the oven chambers for emptying of a coke cake therein, it is loaded with a thin layer of coke, the height of which is about ½ meter. The shallow layer of coke is formed in the car to achieve uniform quenching of the coke when the car is moved beneath the tower. After the quenching operation, the coke is discharged from the car onto a ramp. A very long car must be used to accommodate the shallow coke layer which is formed while the car is moved past an oven chamber during the coke pushing operation.

Smoke collector hoods are used to collect the emissions arising during the coke pushing operation. Such a smoke collector hood is arranged to cover the space in which the coke cake collapses after discharge from the oven chamber. In the case of a very long hot coke car, it is impossible to constantly seal off a hood with the car to an adequate degree to tightness. It is known in the art to arrange a shield on the quenching car and on the hood to achieve a seal but such a seal is ineffective because it is not possible to seal off the hood effectively and constantly during the entire coke pushing operation. On the other hand, a one-point quenching car is known in the art where a relatively short reception area is provided for coke in the car. The height of the coke mass that accumulates in the reception area of the car is such that it is difficult to accommodate the entire volume of coke from an oven chamber. Moreover, special measures are required to insure a uniform distribution of the coke in the relatively short reception area of the car.

SUMMARY OF THE INVENTION

It is an object of the present invention to provide a hot coke quenching car and a smoke hood embodying a construction of parts such that as the car is moved along a coke oven battery through a relatively short distance at a slow rate of travel, loading of hot coke in the car starts at one end thereof in a multiple layer and progresses slowly to the other end of the car while a relatively small gap between the hood and the car is maintained to permit the infiltration of sufficient quantities of air to extract emissions from the coke beneath the hood during the coke pushing operation.

In order to uniformly extract the emissions from the coke in the space beneath the hood where the hot coke cake collapses, a sufficient quantity of air must be drawn into the hood. The air must have an opportunity to penetrate beneath the hood. In addition, the hood must be sufficiently sealed to insure that the emissions are withdrawn by the suction created by extraction pipes connected to the hood without the emissions passing off into the atmosphere.

According to the present invention, horizontal sealing plates are fitted at the level of the top edges of the front and rear end walls on each end of the hot coke car with the total of the lengths of the two plates being not less than the distance of travel by the car while receiving the coke cake during a coke pushing operation. The sealing plates together with the side walls of the hood are disposed to seal off the interior of the hood while leaving a gap or slot which remains constant during the pushing operation to allow the entry of an appropriate quantity of air throughout the pushing operation.

With the sealing plates having a length as discussed above, the sealing relation between the plates and the bottom edge of the hood or a sealing plate situated on the hood is obtained at both end portions of the hot coke car while receiving coke therein, as well as all intermediate positions. In addition to two gaps which are formed at the front and rear end walls of the coke receiving car during the pushing operation, gaps of equal width are also formed along the top edges of the longitudinal walls of the receiving container so that a gap, extending over the entire periphery of the hood or hot coke container, is available to withdraw external air into the space which the hood overlies.

These features and advantages of the present invention as well as others will be more fully understood when the following description is read in light of the accompanying drawings, in which.

Figure 1:
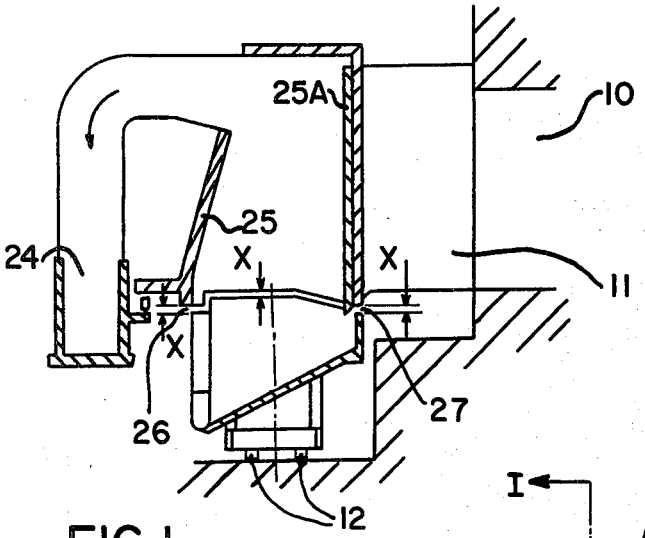
FIG. 1 is a vertical sectional view taken along line I—I of FIG. 2.
Figure 2:
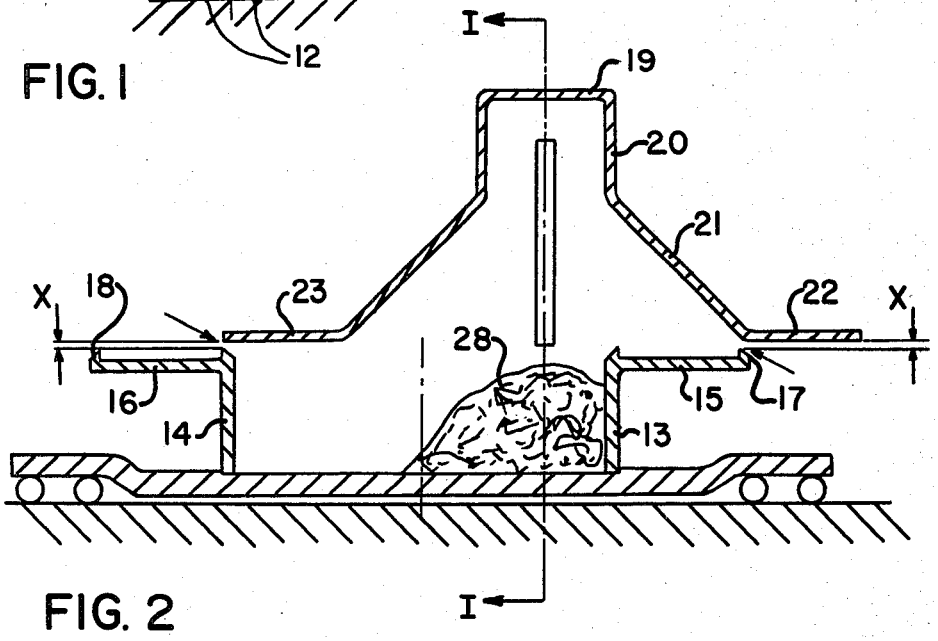
FIG. 2 is a front elevational view of a hot coke car arranged to move from left to right at the start of the coke pushing operation at the discharge side of a coke oven battery.

Turning, first, to FIGS. 1 and 2, a coke oven chamber for emptying a hot coke cake therein is identified by reference numeral 10 and forms one of a plurality of oven chambers in a coke oven battery, the arrangement of which is, per se, well known in the art. A coke cake guide grid 11 is traversed along an operating platform at the discharge side of the coke oven chambers. Rails 12 support a hot coke container or car for traversing movement along the battery at an outwardly-spaced relation generally below the coke cake grid 11. The hot coke car includes a front end wall 13 and a back end wall 14. Horizontal sealing plates 15 and 16 are joined to the top portion of front wall 13 and back wall 14, respectively. A sealing edge 17 is on the forward front edge of plate 15 and a sealing edge 18 is formed on the rear or extended part of plate 16. The length of the sealing plates 15 and 16, i.e., the distance the plates project from walls 13 and 14, respectively, is defined according to the present invention by the expression $s/2$ where s denotes the length of travel of the coke car during the pushing operation.

A smoke hood is disposed generally above the coke car on suitable rail supports at opposite sides of the hood. The hood includes a roof 19 joined with top vertical wall parts 20 situated parallel to the central plane of the oven chamber. Inclined end walls 21 extend from the vertical wall parts 20 to a front sealing plate 22 and a rear sealing plate 23. Side wall 25 forms an outer boundary to the smoke hood (FIG. 1) and a side wall 25A forms the inner boundary of the smoke hood which is provided with a vertical opening to cooperate with the guide grid 11 for passing a hot coke cake into a fall space enclosed by the smoke hood when pushed from the oven chamber. An extraction pipe 24 is connected to the hood for extracting emissions occurring during pushing of the coke cake.

The arrangement of parts of the present invention is designed to keep a constant draft used for extracting emissions during the entire pushing operation. This is achieved by forming a gap around the bottom edge of the hood which is kept at a specific value and required not to undergo any fundamental change during the entire coke pushing operation. The width of the gap is denoted by an X in the drawings; while the arrows in the drawings denote the path of air which is sucked through the gap and entrained with emissions withdrawn toward the extraction pipe 24.

Figure 3:
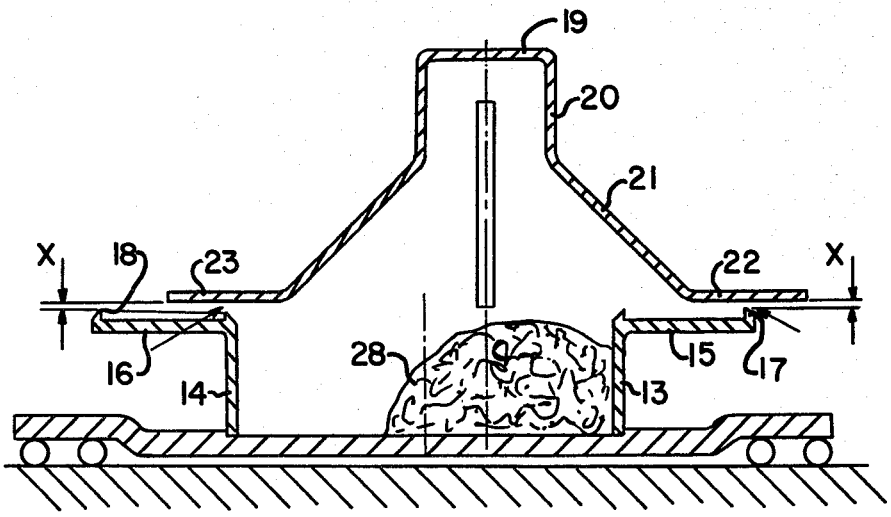
FIGS. 3, 4, 5 and 6 are illustrations similar to FIG. 2 but showing intermediate positions of the hot coke car as it travels from left to right during the coke pushing operation.
Figure 4:
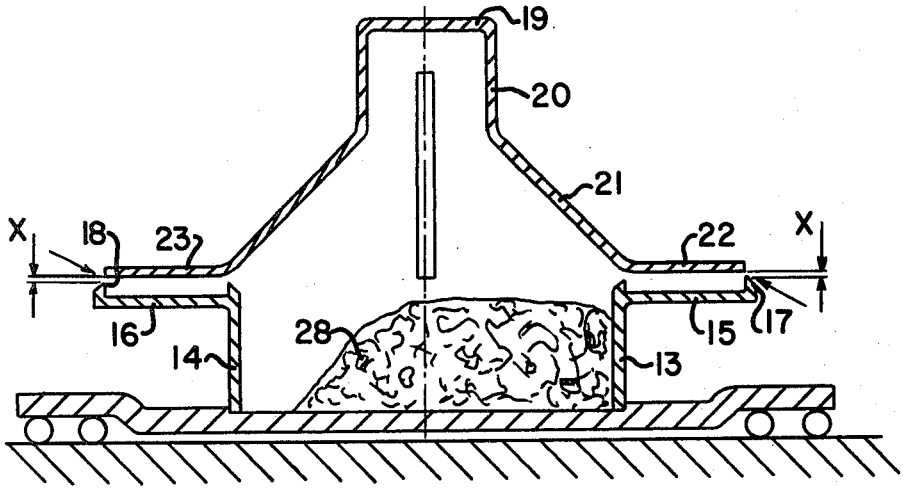
Figure 5:
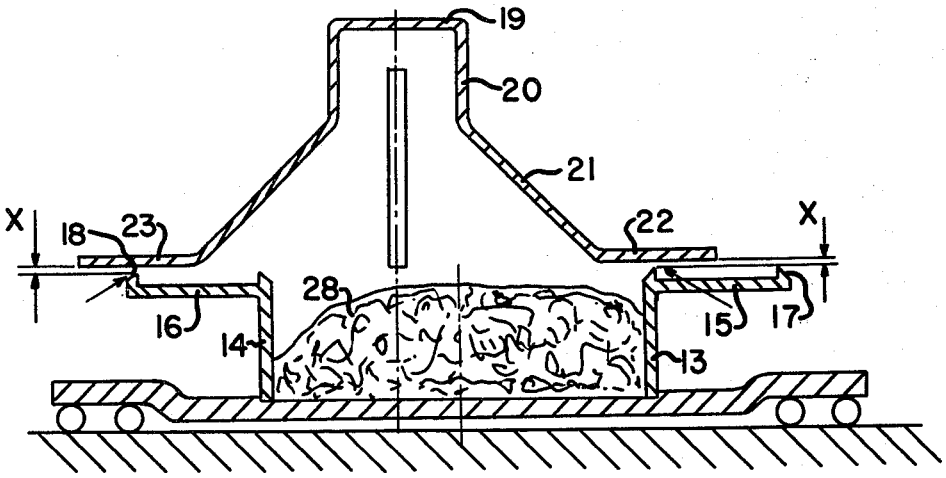
Figure 6:
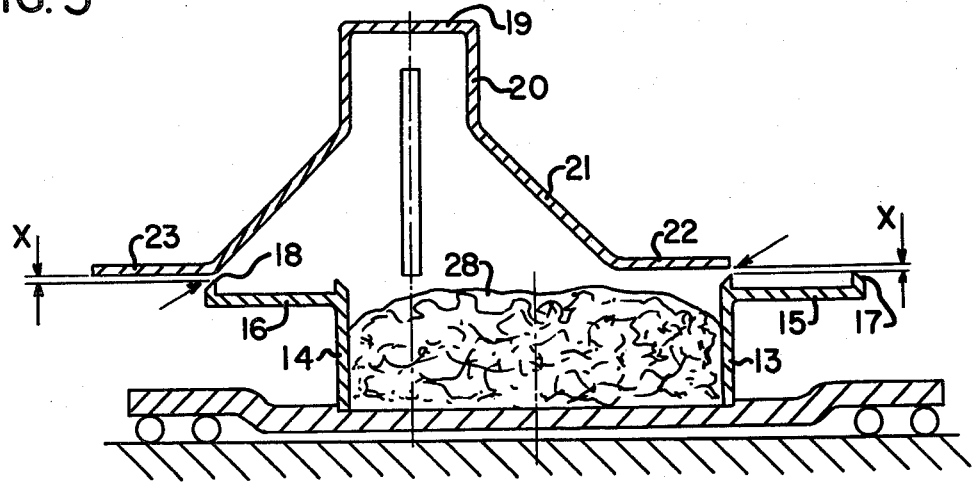

It is apparent from the drawings that the sealing plates 15 and 16 together with the sealing plates 22 and 23 form a gap of constant size from the start of the pushing operation as shown by the arrangement of parts in FIG. 2 and in every position thereafter to the conclusion of the pushing operation as shown by the arrangement of parts in FIG. 6. Reference numeral 26 (FIG. 1) denotes the gap which has, as far as possible, a width X between the outer wall 25 and the top edge of the coke container. Reference numeral 27 identifies the gap at the front edge of inner wall 25A at the operating platform. A gap having a width X extends around the entire hood such that during movement of the coke container beneath the hood, the gaps at the front and rear walls of the container always have the same value. A condition for achieving this is by providing that the plates 15 and 16 and the plates 22 and 23 have a length s/2 which is one-half the path s described by movement of the quenching car during the pushing operation. During travel by the car, a mass of coke 28 accumulates in the car. The coke mass starts to pile up (FIG. 2) at the front wall 13 and at the end of the pushing operation, the mass of coke covers the entire bottom of the container at a substantially equal height. In FIG. 3, the mass of coke 28 has spread in the longitudinal direction of the coke container and further spreading of the coke is denoted by FIG. 4, all of which is due to slow movement of the car during the pushing operation.

It is important that a gap remains at a constant value during the entire pushing operation to insure satisfactory extraction of emissions. The minimum width of the gap is equivalent to tolerances usually maintained in the case of relatively moving machine parts of this size. For example, the gap may be about 150 millimeters. Of course, the maximum width of the gap should not be in the range such that there is any danger of a breakdown to the extraction of emissions.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In combination, a coke quenching car movable on a track extending along the coke discharge side of a battery of coke ovens and adapted to receive a coke cake during a coke pushing operation while said car moves along said track, the quenching car having side walls and front and rear end walls, a first pair of essentially horizontal sealing plates extending outwardly from the upper edges of the front and rear end walls of the quenching car, a smoke collector hood for conducting a coke cake discharged from a coke oven chamber through a fall space into said quenching car, the hood having side walls whose bottom extremities are slightly spaced from the tops of the side walls of said quenching car to provide a gap therebetween, end walls for the hood, and a second pair of essentially horizontal sealing plates extending from the bottom edges of said hood end walls and overlying said first pair of sealing plates while leaving a gap therebetween, each of said sealing plates having a length of at least s/2 where s is the distance covered by the quenching car during a pushing operation, whereby the interior of said quenching car is closed off during the entirety of the pushing operation while the car moves under the hood except for said gaps which allow for the entry of a small quantity of air into the smoke hood during the coke pushing operation.

2. The combination of claim 1 wherein the end walls of said hood comprise sloping end walls.

3. The combination of claim 1 wherein said first- and second-mentioned gaps are substantially equal.

4. The combination of claim 3 wherein said gaps are about 150 millimeters in width.

5. The combination of claim 1 including upstanding sealing edges on the extremities of said first pair of essentially horizontal sealing plates, said gaps being formed between the upper extremities of said sealing edges and the undersides of said second pair of essentially horizontal sealing plates.

* * * * *